United States Patent [19]

Snow et al.

[11] Patent Number: 4,838,525

[45] Date of Patent: Jun. 13, 1989

[54] PORTABLE BARRIER MEANS

[76] Inventors: Claud R. Snow, 210 E., Highway No. 150 South, Crawfordsville, Ind. 47933; W. Robert Snow, 16361 McFadden, Apt. #53, Tustin, Calif. 92680; White: William R., 15 Bent Tree Dr., Little Rock, Ark. 72212

[21] Appl. No.: 126,012

[22] Filed: Nov. 27, 1987

[51] Int. Cl.[4] ..... E04H 17/16

[52] U.S. Cl. ..... 256/26; 256/24; 135/87

[58] Field of Search ..... 256/25, 26, 24, 12.5; 135/902, 901, 87; 47/30, 31, 26

[56] References Cited

U.S. PATENT DOCUMENTS

| | | | |
|---|---|---|---|
| 1,324,668 | 12/1919 | Harris | 47/30 |
| 2,736,041 | 2/1956 | Maloff | 256/25 X |
| 2,981,256 | 4/1961 | Besnah | 135/87 X |
| 2,996,842 | 8/1961 | Weston | 47/30 |
| 3,627,272 | 12/1971 | Friedberg | 256/25 |
| 3,709,237 | 1/1973 | Smith | 256/25 X |

*Primary Examiner*—Andrew V. Kundrat
*Attorney, Agent, or Firm*—Robert A. Spray

[57] ABSTRACT

A barrier shield device, foldable and easily portable, for outdoor use in providing wind-protection or other shielding effects, particularly for use on a sandy beach. A plurality of panels are hinged for a composite shield-effect when folded outwardly for use; and a plurality of spikes, which are supportingly connected to the panels, are movable between an upper position for ease of transport and a lower position in which they are pushed into the ground to hold the panel assembly stable.

The connectors for connecting the spikes to the panels, but permitting the movement of the spikes into the sand or ground, are advantageously provided integrally from portions of the panels themselves, and they are located sufficiently low with respect to the bottom edge of the panels that the spikes are supported in and between both their transport position and their ground-engaging position; and the connectors for the spike or spikes inwardly of the end spikes are formed from the panel-portions adjacent the hinges of the panels, thus achieving the opening for accommodation of the spike by the panel-material which would be an outside corner of the panel assembly whether in folded condition for transport or open condition for shield-effect use.

20 Claims, 1 Drawing Sheet

PORTABLE BARRIER MEANS

FIELD AND BACKGROUND OF THE INVENTION

The present invention relates to a shield-type structure, for protecting the users in situations such as protection from the wind on a sandy beach, i.e., protecting not only the users personally but shielding the users' possessions, their cooking fire, etc.

More particularly, the invention relates to concepts which provide an advantageous barrier shield which is particularly useful as a portable, easily-carried and easily erected, and light-weight assembly, which is nevertheless quite stable and otherwise effective for temporary use, particularly for occasional use such as picnics, beach parties, etc., in which a principal goal of a light-weight portability and relatively light-duty temporary use would make impractical and quite unnecessary the type of permanent construction needed for a long-term use or shelter providing for year-round use involving severities of weather or other harsh conditions.

PRIOR ART STRUCTURES DO NOT PROVIDE THE PARTICULAR ADVANTAGES AND CHARACTERISTICS HERE ACHIEVED

In considering the nature of the barrier and its concepts, and the inventive nature of the present concepts over prior art shields or wind-barriers as known to the inventors, it is not only conceded but emphasized that there are prior art wind-shield devices which would quite effectively block the wind; and structures such as billboards or signboards come to mind. However, such structures would surely be to heavy, non-portable, and too costly and bothersome to install for occasional use; and they would not be movable to various sites.

Lighter, and even foldable screen-type panels are known, but they are likely to be for indoor use, without any convenient means of being made stable for outdoor use or uneven terrain features. Moreover, as intended for indoor use, such screens are not likely to be stable against any significant wind.

Thus, for the occasional picnic or beach party use here achieved advantageously, people seem to just provide or attempt to provide makeshift windbreak barriers, such as turning a table on edge, or piling boxes into a barrier shape, or fastening a blanket on poles or onto a pair of spaced tables, etc.; but such attempts fail to provide the present invention's advantages, particularly of the combination of various features and details of the invention.

THE PRESENT INVENTION, SUMMARIZED

It is against the background of such prior art, which is disadvantageous for the type of occasional and light-duty portable use here shown to be achieved by the present concepts, that the present barrier shield device is considered.

Especially providing advantage for such use, providing protection in situations such as wind as on a beach, the shield device comprises a foldable array of a plurality of panels, with hinge means movably joining adjacent panels but permitting their relative movement from juxtaposed adjacency to a spaced-apart at least almost co-planar relation; and there are provided a plurality of ground-engageable support spikes, and spike-supports carried by the panels, supportingly connecting the spikes to the panels but permitting the spikes to have relative movement, i.e., movement between an upper or transport position and a lower position in which they are firmly forced into the ground for sturdy support of the panel modules.

In a preferred embodiment in which all panels are formed from an integral sheet of stiff corrugated board, with the hinges merely being score-lines of the corrugated board, the economy of cost and materials is further achieved by providing that the spike-supports are economically provided by forcing integral strip portions of the panels from the respective panel, to provide for each support a receiver opening between the strip portion and the respective panel; and the supports are provided along the hinge axes so as to provide the strip from what would be an "outside corner" of the panel-assembly, thus achieving an ample-size receiver opening for a correspondingly ample-size spike by the nature of the "outside corner" relation of the adjacent panels.

By the features thus summarized, and particularly by them in their effect as a combination, and in contrast to the prior art known to the inventors and to what even by hindsight might be asserted as suggestions from the prior art, the present invention provides an advantageous apparatus for achieving the goal of a novel and useful barrier device.

Accordingly, although various separate concepts and components of the overall barrier device are conceded and emphasized to have been widely known in the prior art even in products which provide a barrier function; nevertheless, the prior art not having had the particular concepts and details as here presented and as shown as different from the prior art, even only a fair amount of realistic humility, to avoid consideration of this invention improperly by hindsight, requires the concepts here to be realistically viewed as inventive in their nature.

BRIEF DESCRIPTION OF THE DRAWINGS

The above description of the novel and advantageous portable barrier device of the present invention is of somewhat introductory and generalized form. More particular details, concepts, and features are set forth in the following and more detailed description of an illustrative embodiment, taken in conjunction with the accompanying drawings, which are of somewhat schematic and diagrammatic nature, for showing the inventive concepts of the present invention as are illustrated in this embodiment.

DETAILED DESCRIPTION OF ILLUSTRATIVE EMBODIMENT OF THE INVENTION

Figures 1, 2, 3, 4, 5:
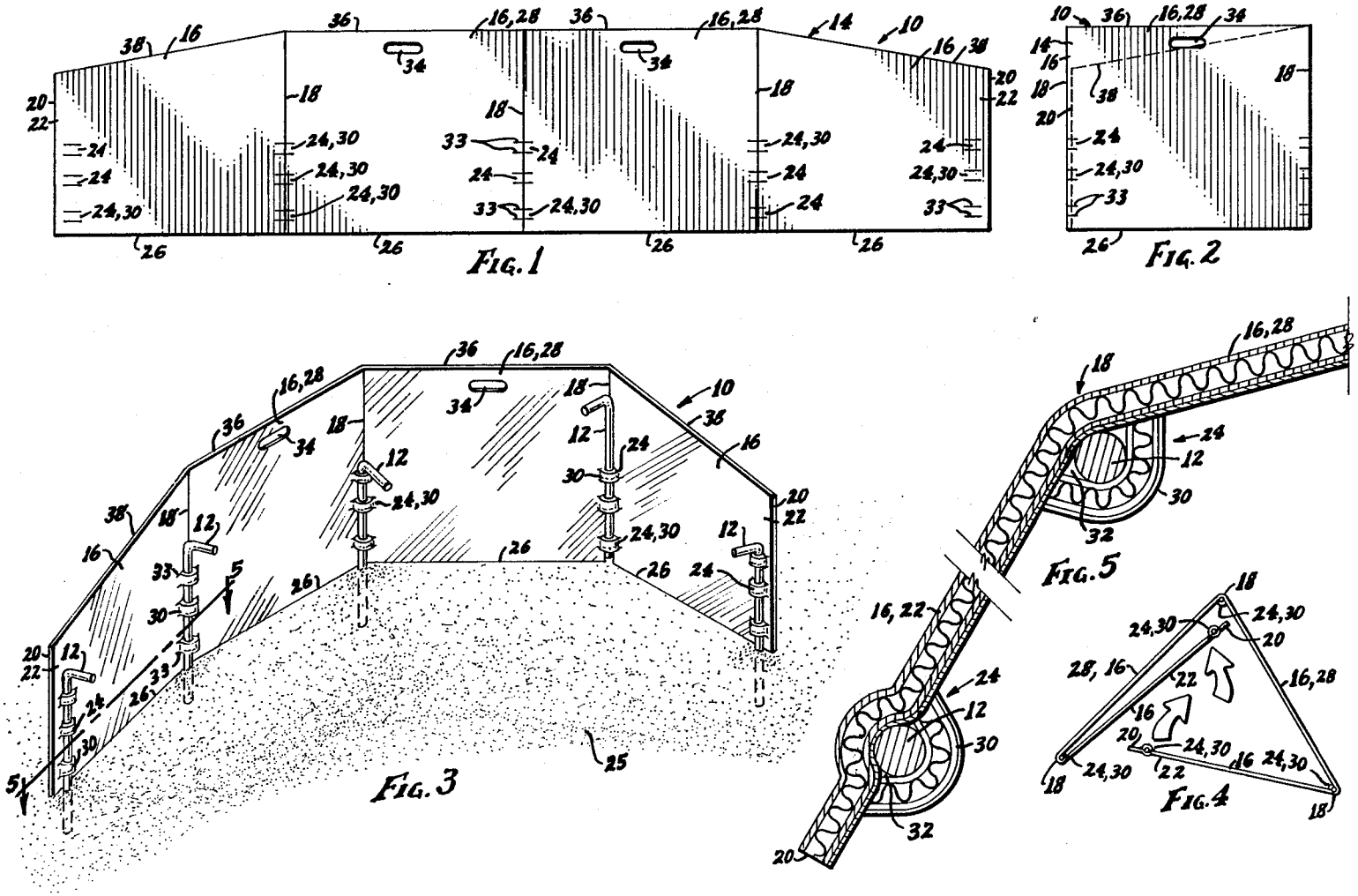
FIG. 1 is an elevation view of a barrier means according to a four-panel embodiment, formed from a single blank of sheet stock.
FIG. 2 is an elevation view of the embodiment of FIG. 1, but shown folded into a transport or carrying condition.
FIG. 3 is a view showing the embodiment of FIGS. 1 and 2, but folded into a barrier condition in which adjacent panels are folded to a non-coplanar relation in which the composite array is that of a sweeping curve as may be desired in a typical beach-party use, in a sort of a wrap-around condition, the holder spikes having been assembled into the end and the hinge-axis suppots, and the spikes being at various positions of penetration into the ground, except that the one at the most rightward hinge-axis has not yet been pushed into the ground.
FIG. 4 is a view of the barrier means in a position of intermediate folding of its panels, the arrows indicating the direction in which two of the panels will move in progressing to a more fully-folded position of transport in which all four panels would be co-planar for ease of carry; although when the two panel-moves as indicated by the arrows are achieved, the two intermediate panels (each then co-planar with a respective and panel) will be in an incompletely-folded condition of a general "V"-shape.
FIG. 5, in greatly enlarged scale, is a horizontal cross-sectional view, generally as shown taken by Section-line 5—5 of FIG. 3, in an embodiment in which the overall blank (and thus all the panels) are formed from a corrugated board, this view illustrating a slight difference in provision of the spike-supports, even though both are formed merely by slitting the panels and inserting a spike, in that the spike-supports along an intermediate hinge-axis are formed by the slit-strips and with the adjacent panel-portions not pushed from the plane of the respective panel, whereas the spike-supports not along a hinge axis are formed by the slit-strips and with the adjacent panel-portions pushed from their panel planes.

As shown in the accompanying drawings, the present invention provides a barrier shield device 10 particularly advantageous for outdoor use, such as to provide protection for one or more persons from the wind; and particularly is the device 10 desirable for use on a beach, by use of spikes 12, all as detailed herein.

The device 10 is provided preferably as a large sheet 14 of corrugated board, providing not only economy of material and of forming, but also lightness of weight, and ease of providing foldability as mentioned herein.

The sheet 14 (integrally or by modules) provides a plurality of panel modules or members 16; and there are hinge means 18 joining adjacent panels members 16 by permitting their relative movement, i.e., a swinging along the axes of the hinge means 18, the panels 16 movable from juxtaposed adjacency which is a convenient transport condition, to a spaced-apart and at least almost co-planar relation of the panels 16 for co-operative use to provide a wide barrier 10 as a screen or shield such as from the wind or other objectionable disturbance and vision.

Stability of the assembly of panels 16 when in outfolded or shield-forming condition is provided by a plurality of ground-engageable support spikes 12, one adjacent the free end 20 of the end ones 22 of the panels 16, and one along the axis of each hinge 18.

There are provided support means 24 which are carried by the panel members 6; and the support means 24 are each adapted to hold a respective one of the spikes 12 supportingly connected to the panel members 16 but permitting relative movement of the spikes, i.e., a vertical movement of each spike 12 between an upper position, for ease of transport without protruding below the panel 16, and a lower position, in which it has been driven or forced downwardly into the sand 25, earth, or sandy soil, firmly seating it to achieve stable support of the outfolded array of panels 16.

It will be noted that the support means 24 are relatively positioned sufficiently low with respect to the bottom or ground-adjacent edge 26 of the panel members 16 that the spikes 12 are supportingly engaging the support means 24 in and between both positions, i.e., the upper or transport position and their lower or ground-engaging position of the spikes 12. At least two, and preferably at least three, of the spike-holding connectors 24 are provided along each hinge-axis 18 or end-edge 20.

For attaining at least a minimum overall length of the assembly of panels 16, and as shown, there are two end panel members 22 and at least one intermediate panel member 28.

Economy of construction is achieved as shown by providing the support means 24 to be formed by forcing an integral strip portion 30 of the panel members 16 from the respective panel member 16 so as to provide for each of the support means 24 a receiver opening 32 between the strip portion 30 and the respective panel member 16, the receiver opening 32 being such as to operatively receive a spike 12, quite effectively movably and supportingly connecting the spike 12 to the respective panel member 16 by what is thus an integrally-formed socket on the panel, merely by panel-slits 33.

In the form shown, the free edge 20 of each of the end panel members 22 is provided to be of shorter length than the other vertical edges of the panel members 16 which are inwardly of those end edges 20; but all the spikes are provided to be of the same length, thus making it a matter of indifference which of the stakes or spikes 12 are used with which of the supports 24. That is, with all the spikes 12 being of substantially the same length as that of the free edge 20 of the end panel members 22, no spike 12 would stick out above the panels 16 regardless of which set of supports 24 is receiving the spike.

Adding to the convenience and portability, there is shown to be provided a hand-hole 34 in each intermediate panel member 28 adjacent the top edge 36 of the panel, the hand-hoels 34 being located with respect to the hinge axes 18 such that the hand-holes are in registration when the panels 16 are folded into flat, carrying position.

It is further noted that top edge 38 of each end panel 22 is inclined in accordance with the difference in height of the end edges 20 in comparison to the inner panel edges; and the hand holes 34 are provided in a position high enough as to be above the inclined top edge 38 of the end panels 22 when the panel members 16 are folded flat, i.e., in their transport or carry position in which the panel members 16 are folded in a position of juxtaposed adjacency for ease of carry.

A special detail as to the support-strips 30 of supports 24, when the panels 16 are formed from sheet stock which is not considered stretchable to push the strip 30 to be offset from the panel 16, is that the support means 24 inwardly of the free ends 22 of the end panel members 20 are provided by forcing out the integral strip portion 30 from the adjacent portions of two adjacent panel members 16 at their hinge means connection 18 (this being an "outside corner" of the array of panels 16 regardless of whether the panels 16 are folded to their closed-flat or carrying condition, or their folded-open or barrier-forming condition); and thus, without a stretching of the material of the panels 16 there is achieved a receiving opening 32 of a size to operatively receive a spike 12 of substantial cross-sectional size; and this is because the non-coplanar relation of those adjacent panels 16 at an "outside corner" permits the strip 30 to be merely pushed into the space between the planes of the panels 16, without stretching.

This is another advantage of providing, as shown, that the support means 24 are provided along the axis of the hinge means 18; and the corner-nature of the hinge axes 18 in the folded-open condition of the panels 16 provides extra stiffness and rigidity in comparison to the relatively low rigidity of the panels 16 themselves.

CONCLUSION

It is thus seen that a portable barrier device, constructed and used according to the inventive concepts herein set forth, provides novel concepts of a desirable and advantageous device, yielding the advantages of a barrier shield which provides special and particular advantages when used as a wind-breaker or wind-barrier for occasional use such as for picnics or beach parties, as particular settings of use.

In summary as to the nature of the overall device's advantageous concepts, their inventiveness is shown by novel features of concept and construction shown here in advantageous combination and by the novel concepts hereof not only being different from all the prior art known, but because the achievement is not what is or has been suggested to those of ordinary skill in the art, especially realistically considering this as a combination comprising components which individually are similar in nature to what is well known to most persons, surely including most of the many makers and users of panels and foldable shields or screens for many years, throughout the entire world. No prior art has suggested the modifications of any prior art to achieve the particulars of the novel concepts here achieved, with the special advantages which the overall device provides.

The differences of concepts and construction are specified herein, yielding advantages especially in such easily-movable and easily-portable use, even though many and different type devices which would provide barrier screen function and of various other natures have been known for years; and quite certainly no particular combination of prior art details as here presented in this overall combination has been suggested by the prior art, this achievement in its particular details being a substantial and advantageous departure from prior art, even though the prior art has had panels for a multiplicity of uses for many years. And particularly is the overall difference from the prior art significant when the non-obviousness is viewed by a consideration of the subject matter of this overall device as a whole, as a combination integrally incorporating features different from the prior art, in contrast to merely separate details of novelty themselves, and further in view of the prior art devices not achieving particular advantages here achieved by this combination.

Accordingly, it will thus be seen from the foregoing description of the invention according to this illustrative embodiment, considered with the accompanying drawings, that the present invention provides new and useful concepts of a novel and advantageous portable barrier device having and yielding desired advantages and characteristics in formation and use, and accomplishing the intended objects, including those hereinbefore pointed out and others which are inherent in the invention.

Modifications and variations may be effected without departing from the scope of the novel concepts of the invention; accordingly, the invention is not limited to the specific embodiment, or from or arrangement of parts herein described or shown.

We claim:

1. A barrier shield device for outdoor use, such as to provide protection for the user from the wind as on a beach, comprising:

a plurality of panel members;

hinge means joining adjacent panel members but permitting relative movement thereof from juxtaposed adjacency to a spaced-apart at least almost co-planar relation;

a plurality of ground-engageable support spikes;

support means bridging the hinge means and carried by at least two of the panel members, and located at or adjacent the outer edges of the assembly of panel member when they are in said spaced-apart at least almost co-planar relation, and those support means are adapted to hold at least two of the spikes in widely spaced relationship for holding the panel members in said spaced-apart at least almost co-planar relation, and supportingly connected to at least two of the panel members, but those support means permitting relative movement of the spikes between an upper position for ease of transport and a lower position firmly seated into the ground;

the relative movement permitted for the spikes being such that, with the panel members standing on edge, the spikes may be pushed into the ground for firmly holding the panel members to the ground;

the support means being relatively positioned sufficiently low with respect to the ground-adjacent edge of the panel members that the spikes are supportingly engaging the support means in and between their said upper or transport position and their lower ground-engaging position.

2. A barrier shield device according to claim 1, in a combination in which there are two end panel members and at least one intermediate panel member, the end panels being held widely spaced by the spikes.

3. A barrier shield device according to claim 1, in a combination in which the support means are provided by forcing integral strip portions of the panel members from the respective panel member so as to provide for each of the support means a receiver opening between the strip portion and the respective panel member, the receiver opening being such as to operatively receive a spike movably and supportingly connected to the respective panel member as aforesaid.

4. A barrier shield device according to claim 2, in a combination in which the support means are provided by forcing integral strip portions of the panel members from the respective panel member so as to provide for each of the support means a receiver opening between the strip portion and the respective panel member, the receiver opening being such as to operatively receive a spike movably and supportingly connected to the respective panel member as aforesaid.

5. A barrier shield device for outdoor use, such as to provide protection for the users from the wind as on a beach, comprising:

a plurality of panel members;

hinge means joining adjacent panel members but permitting relative movement thereof from juxtaposed adjacency to a spaced-apart at least almost co-planar relation;

a plurality of ground-engageable support spikes;

support means carried by the panel members, and adapted to hold the spikes supportingly connected to the panel members but permitting relative movement thereof between an upper position for ease of transport and a lower position firmly seated into the ground;

the relative movement permitted for the spikes being such that, with the panel members standing on edge, the spikes may be pushed into the ground for firmly holding the panel members to the ground;

the support means being relatively positioned sufficiently low with respect to the ground-adjacent edge of the panel members that the spikes are supportingly engaging the support means in and between their said upper or transport position and their lower or ground-engaging position;

in which there are two end panel members and at least one intermediate panel member;

in a combination in which the free edge of the end panel members is provided to be of shorter length than the other vertical edges of the panel members, but all the spikes are provided to be of the same length.

6. A barrier shield device according to claim 5, in a combination in which the spikes are all of substantially the same length as that of the free edge of the end panel members.

7. A barrier shield device according to claim 5, in a combination in which hand-holes are provided in each intermediate panel member, adjacent the top edge thereof.

8. A barrier shield device for outdoor use, such as to provide protection for the users from the wind as on a beach, comprising:

a plurality of panel members;

hinge means joining adjacent panel members but permitting relative movement thereof from juxtaposed adjacency to a spaced-apart at least almost co-planar relation;

a plurality of ground-engageable support spikes;

support means carried by the panel members, and adapted to hold the spikes supportingly connected to the panel members but permitting relative movement thereof between an upper position for ease of transport and a lower position firmly seated into the ground;

the relative movement permitted for the spikes being such that, with the panel members standing on edge, the spikes may be pushed into the ground for firmly holding the panel members to the ground;

the support means being relatively positioned sufficiently low with respect to the ground-adjacent edge of the panel members that the spikes are supportingly engaging the support means in and between their said upper or transport position and their lower or ground-engaging position;

in which there are two end panel members and at least one intermediate panel member;

in which hand-holes are provided in each intermediate panel member, adjacent the top edge thereof;

in which the free edge of the end panel members is provided to be of a shorter length than the other vertical edges of the panel member, the top edge of each end panel being inclined in accordance with that difference in height, and the hand holes being provided in a position high enough as to be above the said inclined top edge when the panel members are in their relation of juxtaposed adjacency.

9. A barrier shield device for outdoor use, such as to provide protection for the users from the wind as on a beach, comprising:

a plurality of panel members;

hinge means joining adjacent panel members but permitting relative movement thereof form juxtaposed adjacency to a spaced-apart at least almost co-planar relation;

a plurality of ground-engageable support spikes;

support means carried by the panel members, and adapted to hold the spikes supportingly connected to the panel members but permitting relative movement thereof between an upper position for ease of transport and a lower position firmly seated into the ground.

the relative movement permitted for the spikes being such that, with the panel members standing on edge, the spikes may be pushed into the ground for firmly holding the panel members to the ground;

the support means being relatively positioned sufficiently low with respect to the ground-adjacent edge of the panel members that the spikes are supportingly engaging the support means in and between their said upper or transport position and their lower or ground-engaging position;

in which the support means are provided by forcing integral strip portions of the panel members from the respective panel member so as to provide for each of the support means a receiver opening between the strip portion and the respective panel member, the receiver opening being such as to operatively receive a spike movably and supportingly connected to the respective panel member as aforesaid;

in a combination in which the support means inwardly of the free ends of the end panel members are provided by forcing out an integral strip portion from the adjacent portions of two adjacent panel members at their hinge means connection, thus achieving a receiving opening of a size to operatively receive a spike of substantial cross-sectional size by the non-coplanar relation of those adjacent panels.

10. A barrier shield device for outdoor use, such as to provide protection for the users from the wind as on a beach, comprising:

a plurality of panel members;

hinge means joining adjacent panel members but permitting relative movement thereof from juxtaposed adjacency to a spaced-apart at least almost co-planar relation;

a plurality of ground-engageable support spikes;

support means carried by the panel members, and adapted to hold the spikes supportingly connected to the panel members but permitting relative movement thereof between an upper position for ease of transport and a lower position firmly seated into the ground;

the relative movement permitted for the spikes being such that, with the panel members standing on edge, the spikes may be pushed into the ground for firmly holding the panel members to the ground;

the support means being relatively positioned sufficiently low with respect to the ground-adjacent edge of the panel members that the spikes are supportingly engaging the support means in and between their said upper or transport position and their lower or ground-engaging position;

in which there are two end panel members and at least one intermediate panel member;

in which the support means are provided by forcing integral strip portions of the panel members from the respective panel member so as to provide for each of the support means a receiver opening between the strip portion and the respective panel member, the receive opening being such as to operatively receive a spike movably and supportingly connected to the respective panel member as aforesaid;

in a combination in which the support means inwardly of the free ends of the end panel members are provided by forcing out an integral strip portion from the adjacent portions of two adjacent panel members at their hinge means connection, thus achieving a receiving opening of a size to operatively receive a spike of substantial cross-sectional size by the non-coplanar relation of those adjacent panels.

11. A barrier shield device according to claim 8, in a combination in which the support means inwardly of the free ends of the end panel members are provided by forcing out an integral strip portion from the adjacent portions of two adjacent panel members at their hinge means connection, thus achieving a receiving opening of a size to operatively receive a spike of substantial cross-sectional size by the non-coplanar relation of those adjacent panels.

12. A barrier shield device for outdoor use, such as to provide protection for the users from the wind as on a beach, comprising:

a plurality of panel members;

hinge means joining adjacent panel members but permitting relative movement thereof from juxtaposed adjacency to a spaced-apart at least almost co-planar relation;

a plurality of ground-engageable support spikes;

support means carried by the panel members, and adapted to hold the spikes supportingly connected to the panel members but permitting relative movement thereof between an upper position for ease of transport and a lower position firmly seated into the ground;

the relative movement permitted for the spikes being such that, with the panel members standing on edge, the spikes may be pushed into the ground for firmly holding the panel members to the ground;

the support means being relatively positioned sufficiently low with respect to the ground-adjacent edge of the panel members that the spikes are supportingly engaging the support means in and between their said upper or transport position and their lower or ground-engaging position;

in a combination in which the support means are provided along the axis of the hinge means.

13. A barrier shield device for outdoor use, such as to provide protection for the users from the wind as on a beach, comprising:

a plurality of panel members;

hinge means joining adjacent panel members but permitting relative movement thereof from juxtaposed adjacency to a spaced-apart at least almost co-planar relation;

a plurality of ground-engageable support spikes;

support means carried by the panel members, and adapted to hold the spikes supportingly connected to the panel members but permitting relative movement thereof between an upper position for ease of transport and a lower position firmly seated into the ground;

the relative movement permitted for the spikes being such that, with the panel members standing on edge, the spikes may be pushed into the ground for firmly holding the panel members to the ground;

the support means being relatively positioned sufficiently low with respect to the ground-adjacent edge of the panel members that the spikes are supportingly engaging the support means in and between their said upper or transport position and their lower or ground-engaging position;

in which there are two end panel members and at least one intermediate panel member;

in a combination in which the support means are provided along the axis of the hinge means.

14. A barrier shield device for outdoor use, such as to provide protection for the users from the wind as on a beach, comprising:

a plurality of panel members;

hinge means joining adjacent panel members but permitting relative movement thereof from juxtaposed adjacency to a spaced-apart at least almost co-planar relation;

a plurality of ground-engageable support spikes;

support means carried by the panel members, and adapted to hold the spikes supportingly connected to the panel members but permitting relative movement thereof between an upper position for ease of transport and a lower position firmly seated into the ground.

the relative movement permitted for the spikes being such that, with the panel members standing on edge, the spikes may be pushed into the ground for firmly holding the panel members to the ground;

the support means being relatively positioned sufficiently low with respect to the ground-adjacent edge of the panel members that the spikes are supportingly engaging the support means in and between their said upper or transport position and their lower or ground-engaging position;

in which the support means are provided by forcing integral strip portions of the panel members from the respective panel member so as to provide for each of the support means a receiver opening between the strip portion and the respective panel member, the receiver opening being such as to operatively receive a spike movably and supportingly connected to the respective panel member as aforesaid;

in a combination in which the support means are provided along the axis of the hinge means.

15. A barrier shield device for outdoor use, such as to provide protection for the users from the wind as on a beach, comprising:

a plurality of panel members;

hinge means joining adjacent panel members but permitting relative movement thereof from juxtaposed adjacency to a spaced-apart at least almost co-planar relation;

a plurality of ground-engageable support spikes;

support means carried by the panel members, and adapted to hold the spikes supportingly connected to the panel members but permitting relative movement thereof between an upper position for ease of transport and a lower position firmly seated into the ground;

the relative movement permitted for the spikes being such that, with the panel members standing on edge, the spikes may be pushed into the ground for firmly holding the panel members to the ground;

the support means being relatively positioned sufficiently low with respect to the ground-adjacent edge of the panel members that the spikes are supportingly engaging the support means in and between their said upper or transport position and their lower or ground-engaging position;

in which there are two end panel members and at least one intermediate panel member;

in which the support means are provided by forcing integral strip portions of the panel members from the respective panel member so as to provide for each of the support means a receiver opening between the strip portion and the respective panel member, the receiver opening being such as to operatively receive a spike movably and supportingly connected to the respective panel member as aforesaid;

in a combination in which the support means are provided along the axis of the hinge means.

16. A barrier shield device according to claim 5, in a combination in which the support means are provided along the axis of the hinge means.

17. A barrier shield device according to claim 2, in a combination in which the free edge of the end panel members is provided to be of shorter length than the other vertical edges of the panel members, but all the spikes are provided to be of the same length.

18. A barrier shield device according to claim 17, in a combination in which the spikes are all of substantially the same length as that of the free edge of the end panel members.

19. A barrier shield device according to claim 7, in a combination in which the free edge of the end panel members is provided to be of a shorter length than the other vertical edges of the panel members, the top edge of each end panel being inclined in accordance with that difference in height, and the hand holes being provided in a position high enough as to be above the said inclined top edge when the panel members are in their relation of juxtaposed adjacency.

20. A barrier shield device according to claim 3, in a combination in which the support means inwardly of the free ends of the end panel members are provided by forcing out an integral strip portion from the adjacent portions of two adjacent panel members at their hinge means connection, thus achieving a receiving opening of a size to operatively receive a spike of substantial cross-sectional size by the non-coplanar relation of those adjacent panels.

* * * * *

UNITED STATES PATENT AND TRADEMARK OFFICE

CERTIFICATE OF CORRECTION

PATENT NO. : 4,838,525

DATED : June 13, 1989

INVENTOR(S) : Claud R. Snow, Robert W. Snow, and William R. White

It is certified that error appears in the above-identified patent and that said Letters Patent is hereby corrected as shown below:

Col. 3, line 37: Change "by" to -- but --.

Col. 3, line 52: Change "6" to -- 16 --.

Col. 4, line 34: Change "hand-hoels" to -- hand-holes --

Col. 6, line 29: After "lower" insert: -- or --.

Col. 7, line 55: Before the comma change "member" to -- members --.

Col. 8, line 7: Change the period to a semi-colon.

Col. 8, line 68: Change "receive" to -- receiver --.

Signed and Sealed this

Twelfth Day of January, 1993

*Attest:*

DOUGLAS B. COMER

*Attesting Officer*

*Acting Commissioner of Patents and Trademarks*